US007009577B1

(12) United States Patent
Dolson

(10) Patent No.: US 7,009,577 B1
(45) Date of Patent: Mar. 7, 2006

(54) MOUNTING MECHANISM FOR SECURING AN ANTENNA IN A LEVEL MEASUREMENT DEVICE

(75) Inventor: Michael Dolson, Millbrook (CA)

(73) Assignee: Siemens Milltronics Process Instruments, Inc., Peterborough (CA)

( * ) Notice: Subject to any disclaimer, the term of this patent is extended or adjusted under 35 U.S.C. 154(b) by 1 day.

(21) Appl. No.: 10/932,850

(22) Filed: Sep. 2, 2004

(51) Int. Cl.
*H01Q 1/12* (2006.01)

(52) U.S. Cl. ..... 343/878; 343/786; 73/290

(58) Field of Classification Search ..... 343/878, 343/786; 73/290
See application file for complete search history.

(56) References Cited

U.S. PATENT DOCUMENTS

| | | | | |
|---|---|---|---|---|
| 2,808,278 | A | 10/1957 | Snyder | 403/180 |
| 2,885,231 | A | 5/1959 | Smith | 403/327 |
| 3,184,196 | A | 5/1965 | Dent | 248/187.1 |
| 3,544,140 | A | 12/1970 | Langheck | 403/189 |
| 5,271,684 | A | 12/1993 | Phillips | 403/106 |
| 5,536,105 | A | 7/1996 | Ise | 403/371 |
| 5,913,634 | A | 6/1999 | Heilig | 403/374.1 |
| 6,310,574 | B1 * | 10/2001 | Fehrenbach et al. | 342/124 |
| 6,661,389 | B1 * | 12/2003 | Griessbaum et al. | 343/786 |
| 6,891,513 | B1 * | 5/2005 | Kienzle et al. | 343/786 |
| 2005/0062483 | A1 * | 3/2005 | Maier | 324/644 |
| 2005/0132797 | A1 * | 6/2005 | Klees et al. | 73/290 V |

* cited by examiner

*Primary Examiner*—Hoang V. Nguyen
(74) *Attorney, Agent, or Firm*—Workman Nydegger

(57) ABSTRACT

A mounting mechanism for detachably coupling an antenna to a level measurement device. The mounting mechanism is coupled to the housing of the level measurement device and comprises an outer ring and an inner ring. The inner ring has a centred opening for receiving an end of the antenna. The inner ring is coupled to the outer ring and rotatable with respect to the outer ring between a locking or engaged position and an unlocking or release position. The inner ring includes one or more cams or pawls, which engage the end of the antenna when in the locked or engaged position. The cams or pawls may include a gripping surface for further securing the antenna end when in the locked position.

20 Claims, 5 Drawing Sheets

MOUNTING MECHANISM FOR SECURING AN ANTENNA IN A LEVEL MEASUREMENT DEVICE

FIELD OF THE INVENTION

This invention relates to a mounting mechanism for an antenna, and more particularly to a mounting mechanism for securing or coupling an antenna to a level measurement device.

BACKGROUND OF THE INVENTION

Level measuring instruments are used to detect the levels of liquids, solids, slurries and interfaces, in holding tanks and other types of storage vessels. Depending on the application, the measurement may comprise a point level measurement, which provides a binary signal output when the level falls below or exceeds set limits, or a continuous measurement, where dynamic processes are constantly monitored and transmitted as an analog signal or a digital signal. In some applications, it is necessary to measure the level of a fluid without having direct contact with the media. In such applications it is beneficial to use non-contact metering technologies such as ultrasonic, sonic, radar or microwave level sensors.

It is known in the art to use transducers or antennas for such level measurement systems. Prior art mounting mechanisms for antennas tend to be cumbersome typically requiring engaging and disengaging parts such as bolts or screws.

Accordingly, there remains a need in the art for a novel antenna mounting mechanism.

SUMMARY OF THE INVENTION

The present invention provides a mounting mechanism for securing an antenna in a level measurement device or apparatus.

In one aspect, the present invention provides a mounting mechanism for attaching an antenna to a level measurement device, the level measurement device includes a housing and the antenna has a shaft end, the mounting mechanism comprises: an outer ring, the outer ring is coupled to the housing; an inner ring, the inner ring is mounted inside the outer ring, and the inner ring has an inner opening for receiving the shaft end of the antenna; a plurality of cams, the cams have a connection for coupling to the inner ring, and the cams have another pivot connection for coupling to the outer ring, the pivot connections permit the inner ring to rotate with respect to the outer ring between a locking position and an unlocking position; in the locking position, the cams engage the shaft end of the antenna, and in the unlocking position, the cams are disengaged from the shaft end of the antenna.

In another aspect, the present invention provides a mounting mechanism for detachably attaching an antenna to a level measurement device, the level measurement device includes a housing and the antenna has a shaft end, the mounting mechanism comprises: an outer ring, the outer ring is coupled to the housing; an inner ring, the inner ring is mounted inside the outer ring, and the inner ring has an inner opening for receiving the shaft end of the antenna; a plurality of means for engaging the shaft end of the antenna, the means for engaging have means for coupling to the inner ring, and the means for engaging have pivoting connection means for connecting to the outer ring, the pivoting connection means permit the inner ring to rotate with respect to the outer ring between a locking position and an unlocking position; in the locking position, the means for engaging engage the shaft end of the antenna, and in the unlocking position, the means for engaging are disengaged from the shaft end of the antenna.

In yet another aspect, the present invention provides a level measurement device for determining the level of a material in vessel, the level measurement device comprises: an enclosure; an antenna; an antenna mounting mechanism, the antenna mounting mechanism connects to the enclosure and includes a mechanism for detachably coupling the antenna; the enclosure contains a controller and a transducer module, the controller includes a receiver module coupled to the transducer module and a transmitter module coupled to the transducer module, the transducer module couples to the antenna, the transmitter module is responsive to control signals from the controller for exciting the antenna to emit energy pulses, and the receiver module receives reflected energy pulses detected by the antenna and converts the detected reflected energy pulses into electrical signals, the controller includes processing means for processing the electrical signals and processing means for generating an echo profile for determining level measurements; the mechanism for detachably coupling the antenna comprises, an outer ring, the outer ring couples to the housing; an inner ring, the inner ring mounts inside the outer ring, and the inner ring has an inner opening for receiving the shaft end of the antenna; a plurality of pawls, the pawls having a connection for coupling to the inner ring, and the pawls having a pivot connection for coupling to the outer ring, the pivot connections permit the inner ring to rotate with respect to the outer ring between a locking position and an unlocking position; in the locking position, the pawls engage the shaft end of the antenna, and in the unlocking position, the pawls disengage from the shaft end of the antenna.

Other aspects and features of the present invention will become apparent to those ordinarily skilled in the art upon review of the following description of specific embodiments of the invention in conjunction with the accompanying drawings.

BRIEF DESCRIPTION OF THE DRAWINGS

Reference is next made to the accompanying drawings, which show, by way of example, embodiments of the present invention and in which.

In the drawings, like reference numerals indicate like components or elements.

DETAILED DESCRIPTION OF THE EMBODIMENTS

Figure 1:
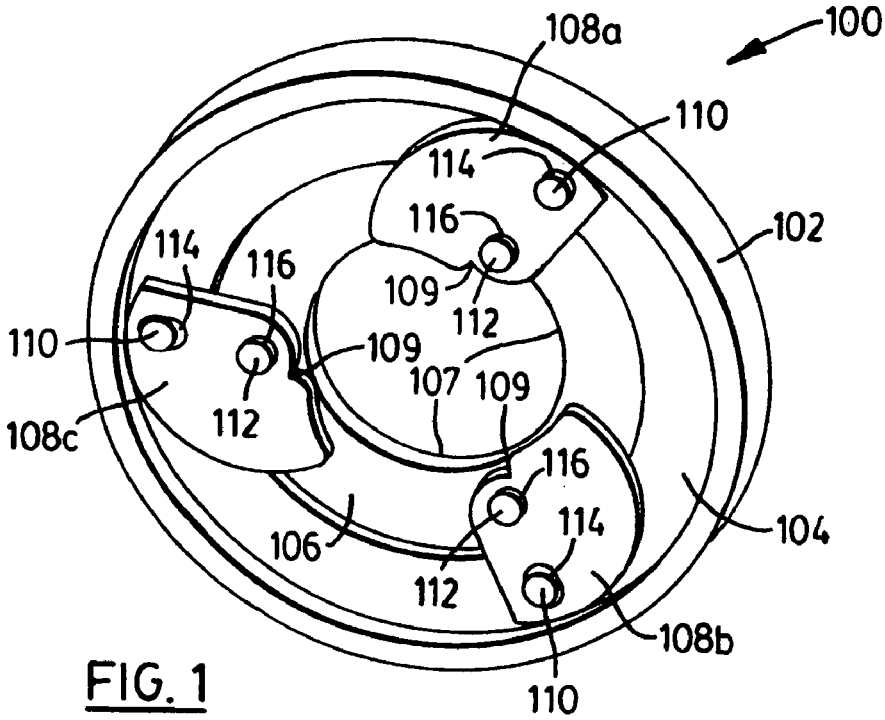
FIG. 1 shows in diagrammatic form a mounting mechanism according to the present invention in an unlocked or disengaged position.
Figure 3:
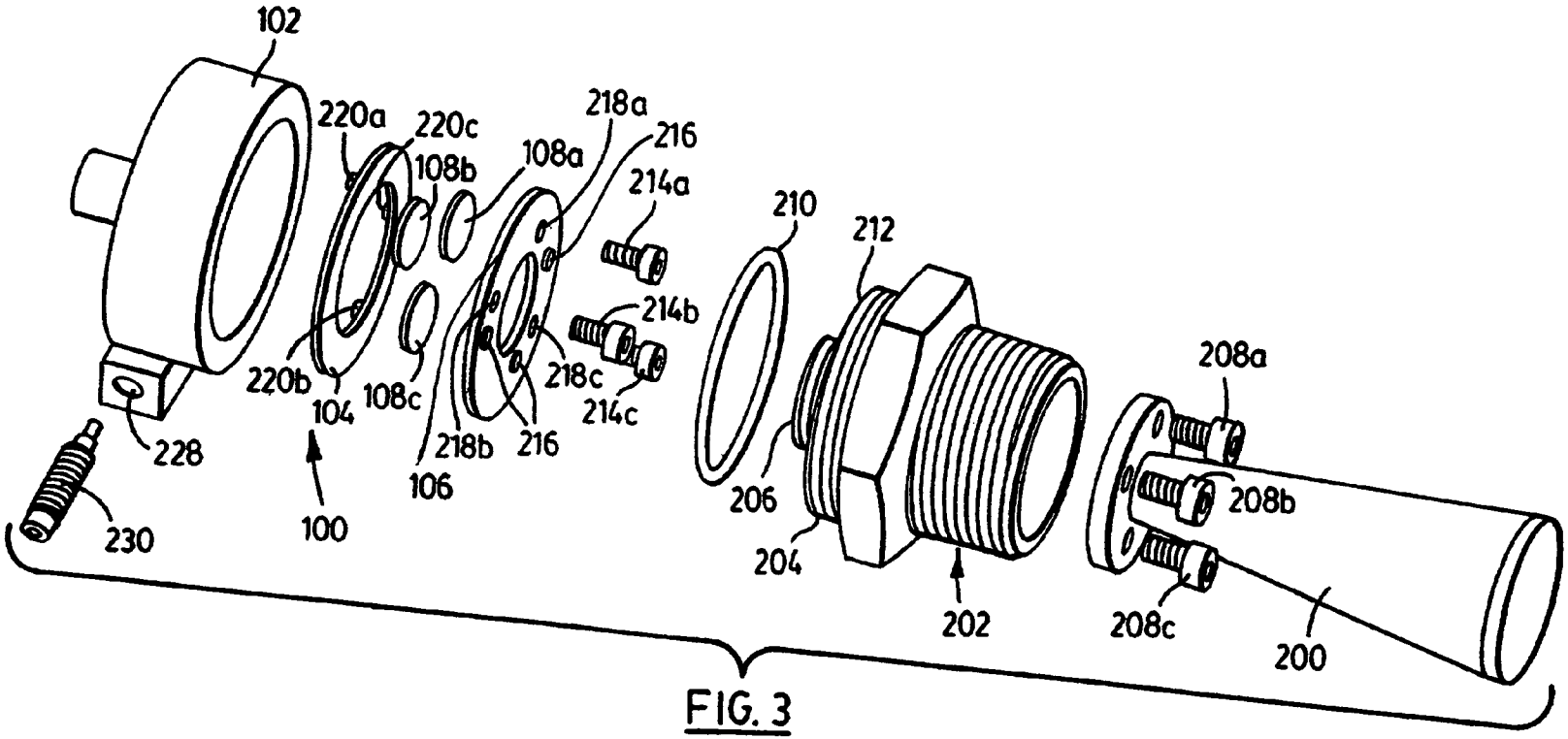
FIG. 3 provides an exploded view of the mounting mechanism of FIG. 1 and the lower portion of an antenna.
Figure 4:
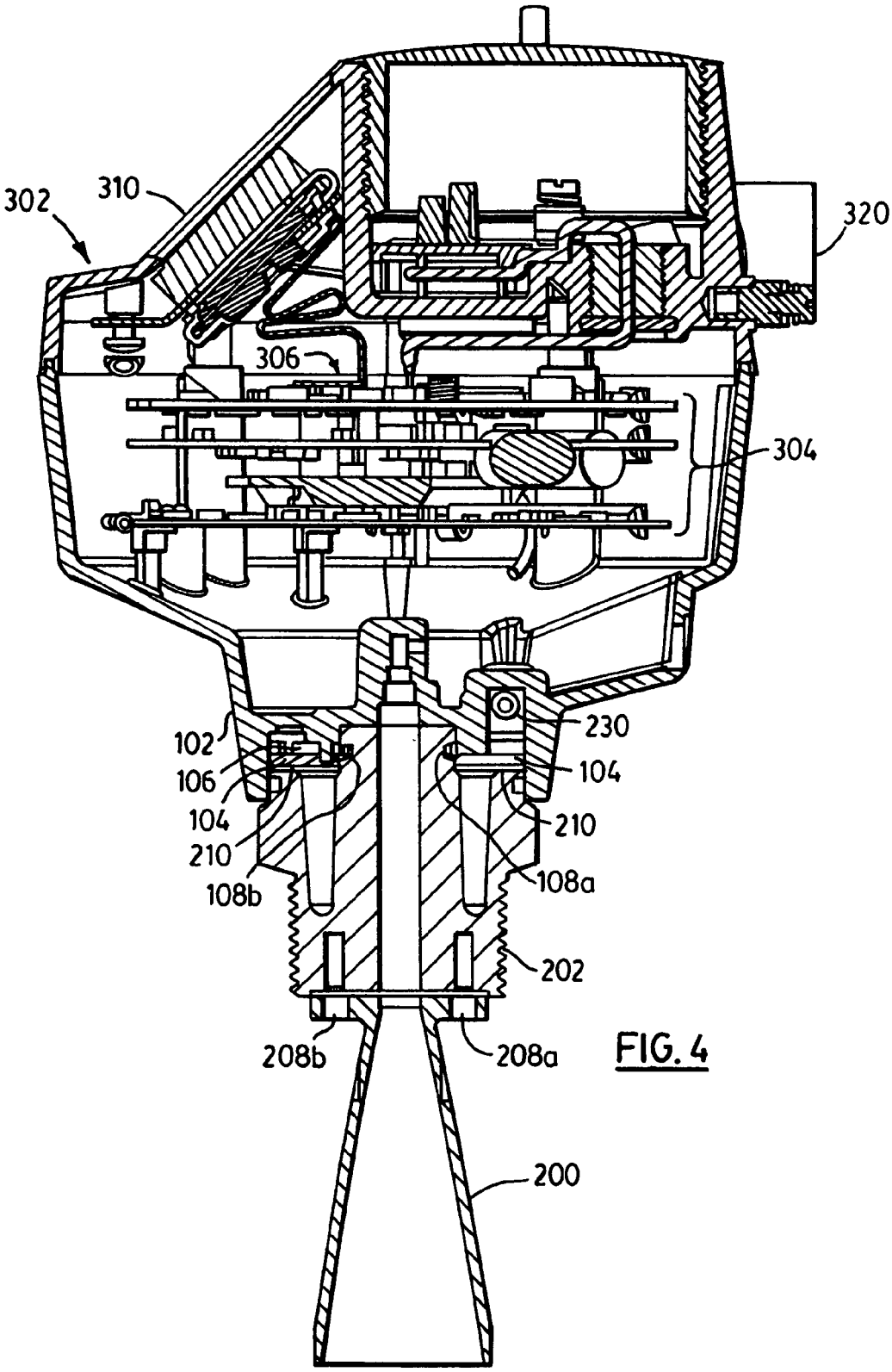
FIG. 4 is an external view of a level measurement device incorporating a mounting mechanism according to the present invention.
Figure 5:
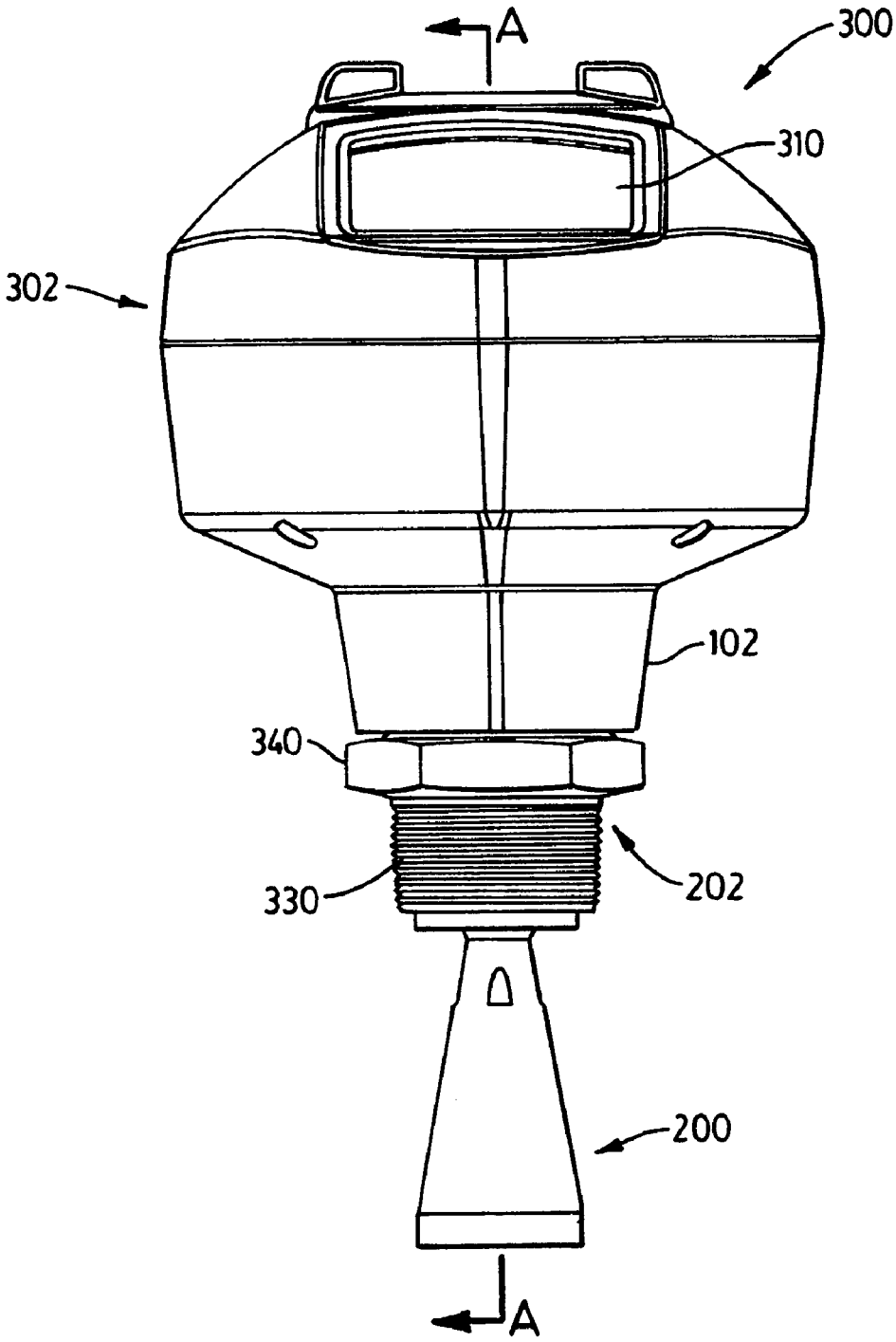
FIG. 5 is a cross-sectional view of a level measurement device of FIG. 4 taken along the line A—A.

Reference is first made to FIG. 1 which shows a mounting mechanism in accordance with the present invention and indicated generally by reference 100. The mounting mechanism 100 is suitable for mounting or securing an antenna 200 as shown in FIG. 3 to a level measurement device 300 (as shown in FIGS. 4 and 5).

As shown in FIG. 1, the mounting mechanism 100 comprises a housing member 102, an outer ring 104 and an inner ring 106. The inner ring 106 is circumscribed by the outer ring 104, i.e. positioned within the outer ring 104. The inner 106 and the outer 104 rings are mounted inside the housing member 102 (e.g. a cylindrical member as shown in FIG. 3 or a section of the housing of the level measurement device 300 as shown in FIGS. 4 and 5), so that the inner ring 106 is independently and separately rotatable, with respect to the outer ring 104, i.e. when the inner ring 106 is rotated, the outer ring 104 is unaffected, and vice versa. As shown, the center of the inner ring 106 comprises a circular opening 107. The circular opening 107 receives a mounting end 202 of the antenna 200 (FIG. 3) which is engaged by the mounting mechanism 100 as will be described in more detail below. The diameter of the opening 107 is based on the diameter of the mounting end 202, e.g. the shaft end, of the antenna 200.

As shown in FIG. 1, the mounting mechanism 100 also includes a plurality of cams or pawls 108, indicated individually by references 108*a*, 108*b* and 108*c* in FIG. 1. Each of the cams or pawls 108 may include a gripping portion or surface 109. Each of the cams 108 includes two mounting pins 110 and 112. The first mounting pin 110 is coupled to the outer ring 104, and the second mounting pin 112 is coupled to the inner ring 102. The first mounting pin 110 allows the cam 108 to pivot with respect to the outer ring 104 when the outer ring 104 or the inner ring 106 is rotated. Similarly, the second mounting pin 112 allows the cam to pivot with respect to the inner ring 106 when the inner ring 106 or the outer ring 104 is rotated. The mounting pin 110 coupled to the outer ring 104 extends through an aperture 114 on the cam 108. The mounting pin 112 coupled to the inner ring 106 extends through another aperture 116 on the cam 108.

As shown in FIG. 1, the apertures 114 and/or 116 in the cams 108 may comprise elliptical holes. The elliptical shaped apertures 114, 116 provide a greater degree of mobility for the respective mounting pins 110, 112 and subsequently the cams 108. When the inner ring 106 is rotated with respect to the outer 104 ring, the cams 108 rotate around the pivot point formed by the mounting pins 110, 112. The elliptical shaped apertures 114, 116 also permit the cams 108 to slide or move further within the confines of the apertures 114, 116.

In the disengaged or unlocked position as shown in FIG. 1, the cams 108 are rotated or pivoted away from the center opening 107. In this position, the gripping surfaces 109 of the cams 108 are moved outside of the center opening 107 to allow the mounting end 202 (e.g. shaft end) of the antenna 200 (FIG. 3) to be freely inserted or removed from the mounting mechanism 100.

Figure 2:
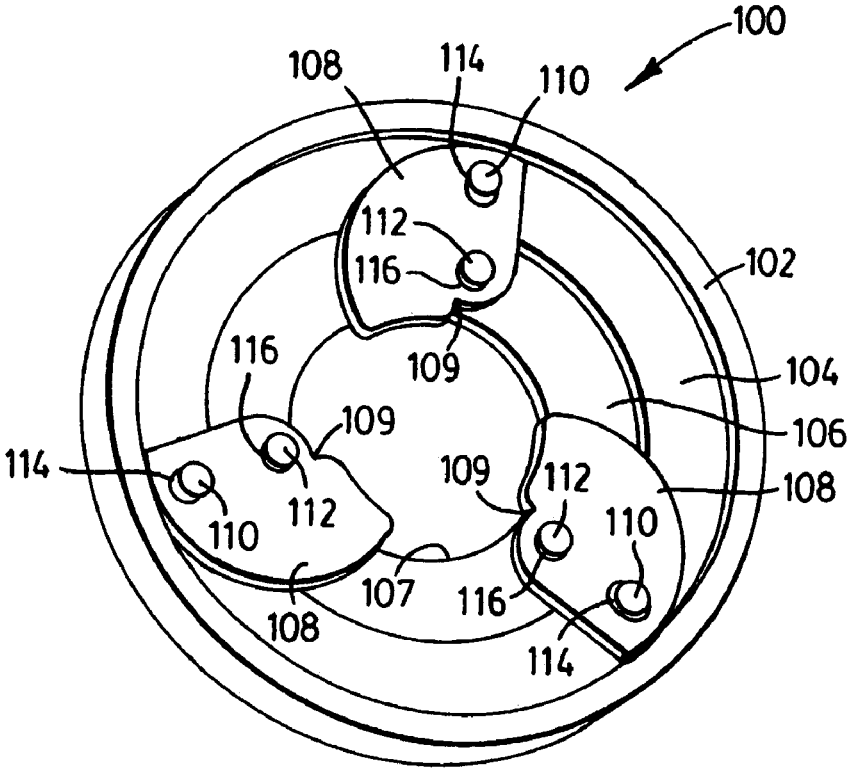
FIG. 2 shows in diagrammatic form the mounting mechanism according to the present invention with the cams in a locked or engaged position.

Reference is next made to FIG. 2, which shows the mounting mechanism 100 in a locked or engaged position. In the figures, like references indicate like components. The outer ring 104 is rotated with respect to the inner ring 106 to lock or engage the cams or pawls 108. As shown, in the locked or engaged position, the cams 108 are moved into the center opening 107 so that the cams 108 and the gripping portions 109 engage the mounting end 202 on the antenna 200 (FIG. 3). As shown in FIG. 3, the mounting end 202 includes a shaft end 204 with an annular groove 206. The groove 206 has width greater than the thickness of the cams 108 and the in engaged position the cams 108 are moved or pivoted into the groove 206. The gripping portions 109 of the cams 108 serve to grip or bite into the groove 206 (FIG. 3) to securely hold the antenna 200. Frictional forces between the shaft 204, the groove 206, the inner ring 106 and the cams 108 allow the mounting mechanism 100 to be locked. In order to return to the disengaged or unlocked position, the inner 106 ring is rotated with respect to the outer ring 104 in the counter-direction. This arrangement allows all of the cams 108 (in this case 3 cams 108) to be locked or unlocked simultaneously.

Reference is next made to FIGS. 3 and 4. FIG. 3 shows in an exploded view the mounting mechanism 100 in accordance with the present invention and the antenna 200 (partial view). FIG. 4 shows a cross-sectional view of a level measurement device 300 incorporating the mounting mechanism 100. As shown, one end of the antenna 200 is joined or connected to the antenna mounting end 202 by four bolts 208 (with three of the bolts 208 being shown in FIG. 3). The mounting end 202 includes an o-ring 210 (e.g. a rubber o-ring) which fits into a groove 212. The o-ring 210 provides a seal between the antenna 200 and the housing member 102 for the mounting mechanism 100. As shown in FIG. 3, the inner ring 106 is secured by three bolts 214 (shown individually by references 214*a*, 214*b* and 214*c*) which pass through mounting holds 216 on the ring 106. The inner ring 106 also includes holes or apertures 218 (shown individually as 218*a*, 218*b*, 218*c*) for receiving and connecting or holding the respective mounting pins 110 for the cams 108. The housing member 102 may comprise a cylindrical member as shown and may be formed as a component or element or section of the housing 302 for the level measurement device 300 as shown in FIGS. 4 and 5.

Referring to FIG. 3, the outer ring 104 includes tabs or stand-offs 220, shown individually as 220*a*, 220*b*, 220*c*. The tabs 220 act as spacers between the face of the outer ring 104 and the housing member 102 to provide a groove or slot for accommodating the shaft end 204, and the annular ring 206 in the shaft end 204, of the antenna mounting end 202 when inserted and the groove 206 engaged by the mounting mechanism 100. As shown in FIG. 3, the housing member 102 includes an aperture, hole or bore 228, which receives a locking/unlocking screw or actuator indicated generally by reference 230.

Figure 6:
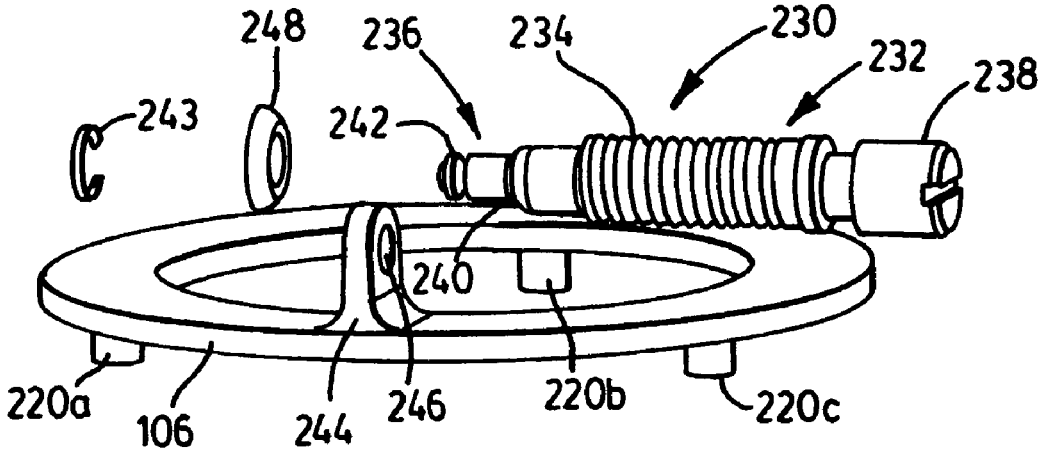
FIG. 6 shows an exploded view of a locking screw for the inner ring of the mounting mechanism.
Figure 7:
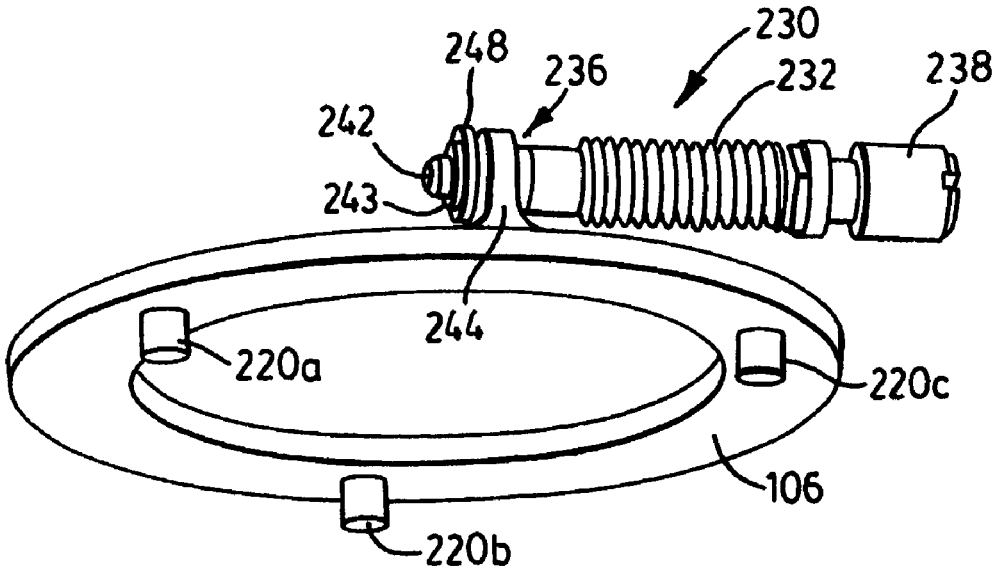
FIG. 7 shows the locking screw coupled to the inner ring of the mounting mechanism.

As shown in FIG. 6, the locking screw or actuator 230 comprises a shaft 232 having a threaded portion 234, a coupler end 236, and a head 238. The threaded portion 234 matches threading in the bore 228 and allows clockwise and counter-clockwise rotation of the actuator 230. The head 238 may comprise a slotted drive recess as shown or a hex socket (not shown). The coupler end 236 includes a groove 240 for an o-ring or other type of sealing gasket. The coupler end 236 also includes a groove 242 for receiving a c-clip 243 or other similar type of fastener. As shown the coupler end 236 of the actuator 230 is coupled to a tab 244 on the outer ring 104. The tab 244 has an aperture or bore 246 through which the coupler end 236 passes. As shown in FIG. 7, the end 236 of the locking screw 230 is secured to the tab 244 on the ring 104 using a spacer washer 248 and the c-clip 243 snapped into the annular groove 242. The o-ring in the groove 240 provides a seal between the bore 228 and the interior of the mechanism 100.

The locking/unlocking or actuator screw 230 allows the outer ring 106 to move relative to the inner ring 106 into the locking or engaging position (for example, as depicted in FIG. 2) and into the unlocking or disengaging position (for example, as depicted in FIG. 1). In operation, clockwise rotation of the actuator screw 230 results in a force being applied to the tab 244 causing the outer ring 104 to rotate. The rotation of the outer ring 104 relative to the inner ring 106 causes the cams or pawls 108 (FIGS. 1 and 2) to engage the shaft end 204 on the mounting end 202 for the antenna 200 (FIG. 3). The rotation of the outer ring 104 provides a simultaneous actuation of the cams 108 which serves to keep the antenna 200 (i.e. the mounting end 202) aligned to the center axis of the mounting mechanism 100 and the clamping force applied by the cams 108 (and their gripping surfaces 109) remains substantially equal. Rotating the actuator screw 230 in the other direction (i.e. counter clockwise) produces a pulling force on the tab 244 and causes the outer ring 104 to rotate in the opposite direction and move the cams 108 into the unlocked position (FIG. 1).

The actuator screw 230 may be secured in the desired actuation position, i.e. locked or unlocked, by tightening a set screw (not shown) screwed into the threaded bore 228.

Reference is made to FIGS. 4 and 5 which show the level measurement device 300 incorporating the mounting mechanism 100.

As shown in FIG. 3, the level measurement device 300 comprises a housing or enclosure 302. The housing 302 may be formed in two sections, with the lower section including or incorporating the housing member 102 for the mounting mechanism 100. The housing 302 holds one or more printed circuit boards or PCB's indicated generally by reference 304. The housing 302 also includes a local display module 310, for example, a liquid crystal display or LCD. If the level measurement device 300 is loop powered, for example, operating on 4 to 20 mA current loop, then the housing 302 includes a loop connection port 320. As shown in FIG. 5, the antenna mount 202 includes a threaded collar 330 and a nut 340. The threaded collar 330 allows the level measurement device 300 to be installed in a vessel (not shown) with a threaded opening (not shown), and tightened in place by the nut 340. The mounting mechanism 100, in turn, allows the housing 302, i.e. the level measurement device 300, to be easily disconnected from the antenna mount 202 and the vessel (not shown).

The circuit boards 304 carry electronic circuitry indicated generally by reference 306 for generating an echo profile and performing the functions associated with level measurement. The electronics for performing the level measurement functions comprise a controller (not shown) and a transducer (not shown). The controller provides the electronics and other circuitry for performing the level measurement or time of flight ranging functions. The controller comprises a microprocessor or microcontroller, a transceiver module, and a power supply. The controller is also coupled a local display module 310. The transceiver module/controller comprises a receiver stage and a transmitter stage.

The echo signal is generated in the operation of a level measurement device. The transducer emits a transmit pulse or energy burst directed at a surface of the material to be measured which is held in a storage vessel. The surface reflects the transmit energy burst and the reflected energy pulses are coupled by the transducer and converted into electrical signals. The electrical signals are applied to the receiver and sampled and digitized by an A/D converter. A signal processor, for example a microprocessor operating under firmware control, takes the digitized output and generates the receive echo signal. The receive echo signal is characterized by one or more valid echoes which correspond to the reflected energy pulses. In known manner, the controller unit executes an algorithm which uses the receive echo signal to calculate the range, i.e. the distance to the reflective surface, from the time it takes for the reflected energy pulse to travel from the reflective surface to the transducer. From this calculation, the distance to the surface of the liquid and thereby the level of the liquid is determined. The controller, e.g. microprocessor or microcontroller, is suitably programmed to perform these operations as will be within the understanding of those skilled in the art.

The present invention may be embodied in other specific forms without departing from spirit or essential characteristics thereof. Certain adaptations and modifications of the invention will be obvious to those skilled in the art. Therefore, the presently discussed embodiments are considered to be illustrative and not restrictive, the scope of the invention being indicated by the appended claims rather than the foregoing description, and all changes which come within the meaning and range of equivalency of the claims are therefore intended to be embraced therein.

What is claimed is:

1. A mounting mechanism for attaching an antenna to a level measurement device, said level measurement device including a housing and said antenna having a shaft end, said mounting mechanism comprising:

an outer ring, said outer ring being coupled to a section of said housing;

an inner ring, said inner ring being mounted inside said outer ring, and said inner ring having an inner opening for receiving the shaft end of the antenna;

a plurality of cams, said cams having a connection for coupling to said inner ring, and said cams having another pivot connection for coupling to said outer ring, said pivot connections permitting said inner ring to rotate with respect to said outer ring between a locking position and an unlocking position;

in said locking position, said cams engaging the shaft end of the antenna, and in said unlocking position, said cams being disengaged from the shaft end of the antenna.

2. The mounting mechanism as claimed in claim 1, wherein at least one of said cams includes a gripping surface, and in said locking position said gripping surface contacting the shaft end of the antenna.

3. The mounting mechanism as claimed in claim 1, wherein a rotation said inner repositions said gripping surfaces.

4. The mounting mechanism as claimed in claim 2, wherein said pivot connection comprises an aperture in said cam and a pin coupled to said outer ring, said pin being in communication with said aperture.

5. The mounting mechanism as claimed in claim 4, wherein said aperture comprises an elliptical opening, and said pin is smaller than said elliptical opening.

6. The mounting mechanism as claimed in claim 5, wherein said cam connection for said inner ring comprises a pivot connection having an aperture in said cam and a pin coupled to said outer ring, said pin being in communication with said aperture.

7. The mounting mechanism as claimed in claim 6, wherein said aperture comprises an elliptical opening, and said pin is smaller than said elliptical opening.

8. The mounting mechanism as claimed in claim 7, wherein the shaft end of the antenna includes an annular groove, and said cams being adapted for engaging said annular groove in said locking position.

9. A mounting mechanism for detachably attaching an antenna to a level measurement device, said level measurement device including a housing and said antenna having a shaft end, said mounting mechanism comprising:

an outer ring, said outer ring being coupled to said housing;

an inner ring, said inner ring being mounted inside said outer ring, and said inner ring having an inner opening for receiving the shaft end of the antenna;

a plurality of means for engaging the shaft end of the antenna, said means for engaging having means for coupling to said inner ring, and said means for engaging having pivoting connection means for connecting to said outer ring, said pivoting connection means permitting said inner ring to rotate with respect to said outer ring between a locking position and an unlocking position;

in said locking position, said means for engaging coupling the shaft end of the antenna, and in said unlocking position, said means for engaging being disengaged from the shaft end of the antenna.

10. The mounting mechanism as claimed in claim 9, wherein at least one of said means for engaging includes gripping means for gripping the shaft end, and in said locking position said gripping means contacting the shaft end of the antenna.

11. The mounting mechanism as claimed in claim 10, wherein said pivoting connection means comprising an aperture in said means for engaging and a pin coupled to said outer ring, said pin being in communication with said aperture.

12. The mounting mechanism as claimed in claim 11, wherein said aperture comprises an elliptical opening, and said pin is smaller than said elliptical opening.

13. The mounting mechanism as claimed in claim 12, wherein said means for coupling for said inner ring comprises a pivot connection having an aperture in said means for engaging and a pin coupled to said outer ring, said pin being in communication with said aperture.

14. A level measurement device for determining the level of a material in vessel, said level measurement device comprising:

an enclosure, an antenna;

an antenna mounting mechanism, said antenna mounting mechanism being connected to said enclosure and including a mechanism for detachably coupling said antenna;

said enclosure containing a controller and a transceiver module, said controller including a receiver module coupled to said transceiver module and a transmitter module coupled to said transceiver module, said transceiver module being coupled to said antenna, said transmitter module being responsive to control signals from said controller for exciting said antenna to emit energy pulses, and said receiver module receiving reflected energy pulses detected by said antenna and converting said detected reflected energy pulses into electrical signals, said controller including processing means for processing said electrical signals and processing means for generating an echo profile for determining level measurements;

said mechanism for detachably coupling said antenna comprising, an outer ring, said outer ring being coupled to said housing;

an inner ring, said inner ring being mounted inside said outer ring, and said inner ring having an inner opening for receiving the shaft end of the antenna;

a plurality of pawls, said pawls having a connection for coupling to said inner ring, and said pawls having another pivot connection for coupling to said outer ring, said pivot connections permitting said inner ring to rotate with respect to said outer ring between a locking position and an unlocking position;

in said locking position, said pawls engaging the shaft end of the antenna, and in said unlocking position, said pawls being disengaged from the shaft end of the antenna.

15. The level measurement device as claimed in claim 14, wherein at least one of said pawls includes a gripping surface, and in said locking position said gripping surface contacting the shaft end of the antenna.

16. The level measurement device as claimed in claim 15, wherein said pivot connection comprises an aperture in said pawls and a pin coupled to said outer ring, said pin being in communication with said aperture.

17. The level measurement device as claimed in claim 16, wherein said aperture comprises an elliptical opening, and said pin is smaller than said elliptical opening.

18. The level measurement device as claimed in claim 17, wherein said pawl connection for said inner ring comprises a pivot connection having an aperture in said pawl and a pin coupled to said outer ring, said pin being in communication with said aperture.

19. The level measurement device as claimed in claim 18, wherein said aperture comprises an elliptical opening, and said pin is smaller than said elliptical opening.

20. The level measurement device as claimed in claim 19, wherein the shaft end of the antenna includes an annular groove, and said pawls being adapted for engaging said annular groove in said locking position.

* * * * *